United States Patent [19]

Heck et al.

[11] Patent Number: 4,768,490

[45] Date of Patent: Sep. 6, 1988

[54] METHOD AND ARRANGEMENT FOR ADAPTING THE MIXTURE CONTROL OF AN INTERNAL COMBUSTION ENGINE

[75] Inventors: Klaus Heck, Waiblingen; Günter Plapp, Filderstadt; Botho Zichner, Schwieberdingen, all of Fed. Rep. of Germany

[73] Assignee: Robert Bosch GmbH, Stuttgart, Fed. Rep. of Germany

[21] Appl. No.: 87,230

[22] Filed: Aug. 20, 1987

[30] Foreign Application Priority Data

Aug. 22, 1986 [DE] Fed. Rep. of Germany ..... 3628628

[51] Int. Cl.[4] ..... F02D 41/30; F02D 37/00

[52] U.S. Cl. ..... 123/489; 123/325; 123/493

[58] Field of Search ..... 123/325, 489, 492, 493

[56] References Cited

U.S. PATENT DOCUMENTS

| | | | |
|---|---|---|---|
| 4,459,962 | 7/1984 | Yamato et al. | 123/325 X |
| 4,490,792 | 12/1984 | Deutsch et al. | 123/493 X |
| 4,599,695 | 6/1986 | Deutsch et al. | 123/325 X |
| 4,633,841 | 1/1987 | Matsuura et al. | 123/493 X |
| 4,644,923 | 2/1987 | Morita et al. | 123/493 |

*Primary Examiner*—Willis R. Wolfe
*Attorney, Agent, or Firm*—Walter Ottesen

[57] ABSTRACT

The invention is directed to a method for the adaptation of mixture control for an internal combustion engine which is set up from operating quantities of the engine such as throttle flap angular position $\alpha$ and rotational speed n. The characteristic field provides a precontrol quantity governing the quantity of fuel to be metered or injected. The method includes the steps of: influencing the precontrol quantity by at least one adaptively changeable corrective quantity (structural adaptation, global adaptation); detecting the negative change velocity ($-d\alpha/dt$) of the throttle flap position angle ($\alpha$); comparing the negative change velocity ($-d\alpha/dt$) with a predetermined threshold value [$-d\alpha/dt(SchAd)$]; evaluating a quantity ($\Delta\alpha$) indicative of the throttle flap change in angular position when the threshold value [$-d\alpha/dt(SchAd)$] is exceeded, the quantity ($\Delta\alpha$) being so evaluated that the mixture adaptation in the precontrol region is inhibited for a predetermined period of time when a corresponding threshold value is exceeded. The invention is also directed to an arrangement for carrying out the above method.

5 Claims, 1 Drawing Sheet

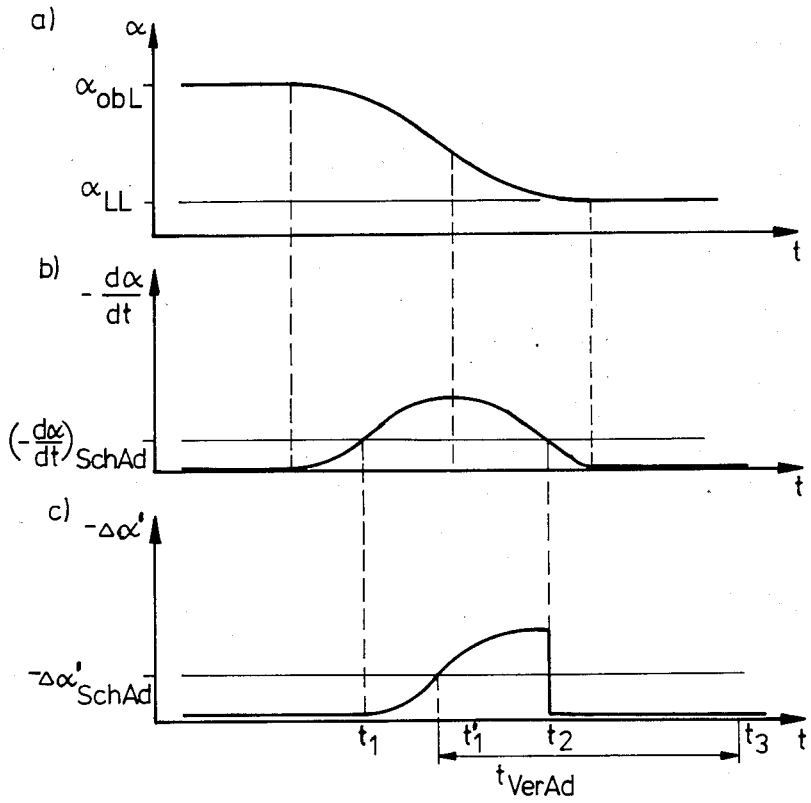
a)
α
αobL
αLL
t
b)
-dα/dt
(-dα/dt)SchAd
t
c)
-Δα'
-Δα'SchAd
t1
t'1
t2
t3
t
tVerAd

METHOD AND ARRANGEMENT FOR ADAPTING THE MIXTURE CONTROL OF AN INTERNAL COMBUSTION ENGINE

FIELD OF THE INVENTION

The invention relates to a method for adapting the mixture control of an internal combustion engine wherein a characteristic field provides a precontrol quantity governing the quantity of fuel to be metered or injected. The characteristic field is set up from operating quantities of the engine such as throttle flap angular position $\alpha$ and rotational speed n. The precontrol quantity is influenced by at least one adaptively changeable correction quantity (structural adaptation, global adaptation). The invention also relates to an arrangement for carrying out the method.

BACKGROUND OF THE INVENTION

It is known to so design mixture metering systems that the proportioning or metering of the fuel takes place according to so-called learning control systems. In this connection, reference can be made to German published patent application DE-OS No. 28 47 021 and British patent No. 20 34 930B. Such a learning control system contains in a permanently active write-read memory, for example, values for the injection which are available during the operation of the engine. By forming such characteristic fields, a quickly reacting precontrol of the injection quantity or generally of fuel metering is provided or also for other operating parameters of the engine suitable for fast changing operating conditions, for instance, ignition timing, exhaust gas recirculation rate, et cetera. Learning adjustment systems can be so designed, for example, that the individual characteristic field values are corrected in dependence upon the operating characteristic values and written into the respective memory.

With respect to the foregoing, it has already been proposed in U.S. patent application Ser. No. 831,476 to structurally influence determined regions of a basic characteristic field via an adaptive precontrol and it has further been suggested to influence each control value obtained from the characteristic field multiplicatively via a global factor, in the sense of a shift of all the characteristic field support points. U.S. patent application Ser. No. 831,476 was filed on Feb. 20, 1986, now U.S. Pat. No. 4,676,215 and is herewith incorporated by reference.

It further has been proposed in U.S. Pat. No. 4,676,215 to change, according to the learning process, the values stored in the characteristic field and selected in dependence upon the operating characteristic quantities of the internal combustion engine, so that not only a single predetermined characteristic field value but also those respective characteristic field values lying in its vicinity can additionally be manipulated in dependence upon the change of the value encountered in each case. U.S. Pat. No. 4,676,215 is herewith incorporated by reference.

In order to be able to introduce a learning process with respect to the precontrol, one needs the characteristic operating quantities, which set up the characteristic field, such as the throttle flap position and the rotational speed. In addition to the characteristic operating quantities, one also needs an actual value indication of the actual operating condition of the internal combustion engine, wherein as the actual value ordinarily the adjustment factor or the control quantity of a lambda-regulator will be evaluated. This control quantity of the lambda-regulator influences therefore in the sense of an adaptive learning the precontrol stage and at the same time serves as a fed-back actual value during the actual adjustment of the mixture control, while establishing the precontrol values from the characteristic field region changed by adaptive learning, as required.

Ordinarily, one will proceed such that the correction factor produced by the lambda-regulator will be averaged, subjected to appropriate boundary conditions, and then incorporated as well into the structural characteristic field superimposed on the basic characteristic field (structural adaptation) and into a global factor (global adaptation). The incorporation takes place in each case on leaving an influence area (adaptation area) defined around each characteristic field support point.

In connection with the adaptive learning processes in the precontrol region for the mixture control of internal combustion engines, it is further known to take into consideration the tank venting control in such internal combustion engines in such a manner that tank venting will be permitted only for certain operating conditions of the engines, and that during this time the adaptation process for the evaluation of the characteristic field is interrupted, that is the mixture adaptation is inhibited. Background with respect to the foregoing is provided in German published patent application DE-OS No. 28 29 958 and in a publication of Robert Bosch GmbH entitled "Motronic"—Technical Bulletin C5/1, August 1981.

The reason for the above is that an active carbon filter, which is associated with the fuel tank and absorbs fuel vapors up to a determined maximum amount, must necessarily be flushed or regenerated during the operation of the motor. This flushing or regeneration occurs in connection with the underpressure developed by the internal combustion engine in the intake region. However, the foregoing results in an additional fuel-air mixture caused by this tank venting. This mixture, as an unmeasured mixture, falsifies the fuel quantity normally determined with high precision and with a complex effort (in the context of fuel injection systems this quantity is determined, for example, by the duration of the injection control command $t_i$) and the total amount of the fuel introduced into the internal combustion engine which results therefrom.

The lambda sensor utilized as the actual value transmitter evaluates, however, the total amount of fuel in relation to the quantity of air and the fuel introduced per unit of time, so that in the learning adaptation in the precontrol region, which is based on the averaged value of the lambda sensor signal, inaccuracies are introduced if the mixture adaptation is not inhibited during the tank venting phase.

The invention is based on the recognition that in an internal combustion engine other sources of error also exist, which can lead to undesirable and insofar falsifying shifting in the mixture adaptation (structural adaptation and/or global adaptation) so that the task of the present invention is to provide that, in adaptive learning in the precontrol characteristic field region, an interruption of the mixture adaptation is always effected when uncontrollable influences of transitory character occur which influences cause a change of the output signal of the actual-value transmitter (lambda sensor).

SUMMARY OF THE INVENTION

The method and arrangement of the invention have the advantage that the stable characteristic field structure in the precontrol region is maintained by means of a learning inhibit for the mixture adaptation, which comes into effect when a negative throttle flap change exceeds a determined amount. It has become apparent that for certain operating conditions, for example for longer (highway) travels in the upper load range (that is for a comparatively wide open throttle flap and correspondingly low underpressure developed by the engine), a fuel accumulation occurs, for instance in the niches and corners of the injection unit, which, seen by itself, is of no importance during the travel because this operation extends over a longer period of time. Should, however, the internal combustion engine change from this operating condition to a lower, partial output range, then the accumulated fuel quantities will be drawn by the underpressure into the intake pipe, which necessarily leads to an excessive enrichment of the mixture. Correspondingly, a leaner condition results from the operation of the lambda-regulator, a corresponding reaction by the evaluation of the average control quantity of the lambda-regulator, and a leaner condition of the learning factors of the precontrol. The inhibition of mixture adaptation during such an operation as provided by the invention prevents the respective characteristic field values which participate here from being permanently changed which otherwise would lead to the result of too lean a mixture setting when these regions are later passed through with small changes of the throttle flap angle.

It is further advantageous that the consideration of the operations within the region of the throttle flap and their utilization for determining the mixture adaptation inhibitions can be accomplished without a great effort. This is accomplished, for example, by setting a corresponding flag in the case of microprocessor-controlled injection equipment, when a predetermined negative throttle flap change speed has occurred. A duration of the inhibition for the mixture adaptation can be derived from the above for a predetermined time span or until there is a drop below predetermined threshold values.

BRIEF DESCRIPTION OF THE DRAWING

An embodiment of the invention is illustrated in the drawing and will be explained in greater detail in the following description. The drawing shows by means of diagrams in (a) the course of the throttle flap setting over time, in (b) the negative change speed of the throttle flap position over time, and in (c) the magnitude of the negative change velocity (corresponding to a sharp throttle flap decrease per unit of time), with indications of threshold values for the corresponding interventions.

DESCRIPTION OF THE PREFERRED EMBODIMENTS OF THE INVENTION

The basic concept of the invention involves preventing a leaning of the learning factors, for example structural factor from the characteristic field for adaptive mixture changes and global factor for multiplicative mixture changes, by inhibiting mixture adaptation, when, after long uniform trips in the upper output ranges and a quick transition to the lower partial output region, an additional quantity of fuel results because of geometrical particularities and the corresponding increase of the underpressure in the intake pipe. This additional fuel quantity is detected by the lambda-regulator as the generator of the actual value for the regulating operation of the mixture supply; however, this additional quantity of fuel has not yet been metered by the appropriate calculation of the actual fuel requirement, in any event not up to this point in time.

For a better understanding of the invention, a few basic possibilities of the learning adaptation in the precontrol region will first be discussed briefly.

For the determination of a duration of injection (or any other indication of the quantity of fuel introduced into an internal combustion engine when carburetors or the like are utilized), an injection duration characteristic field is established in normal operation. This injection duration characteristic field is preferably dependent upon rotational speed (rpm) and throttle flap position and is set up over a predetermined number of rpm signal support points and throttle flap signal support points. In numerical values, for example, fifteen rpm signal support points and fifteen throttle flap signal support points can be provided. This basic injection characteristic field can then, for example, be set up for a special vehicle of the particular vehicle type. A structural characteristic field can then be superposed on the basic injection characteristic field. This structural characteristic field, for example, can have eight rpm signal support points and eight throttle flap signal support points. These support points represent a partial quantity of the $15 \times 15$ support points of the injection duration characteristic field. For the adaptation of the boundary conditions which operate multiplicatively on the mixture formation (for example, ambient pressure differences because of altitude, temperature, aging of components and the like), a so-called global factor can be utilized. In order to prevent the occurrence of a leaning of these learning factors, the structural factor and the global factor by the operations described above, a mixture adaptation is inhibited by means of an evaluation of the throttle flap position as well as the speed with which the throttle flap changes position and by means of a comparison with threshold values. More specifically, the further processing of the averaged control quantities of the lambda-regulator for the learning process in the precontrol region is interrupted.

For a better understanding of the invention and of the following descriptions, the following abbreviations will be first provided:

| | |
|---|---|
| $\alpha LL$ | throttle flap angle when idling |
| $\alpha obL$ | throttle flap angle in upper output range |
| $\left(\frac{d\alpha}{dt}\right)_{SchAd}$ | $\frac{d\alpha}{dt}$ -threshold for mixture adaption |
| $\Delta\alpha_{SchAd}$ | $\Delta\alpha$-threshold for mixture adaption |
| $t_{VerAd}$ | inhibit time for mixture adaption |
| $-d\alpha/dt$ | negative change speed of the throttle flap angle (speed at which the throttle flap moves from one position to another) |
| $-\Delta\alpha'$ | difference value of the throttle flap angle |

The course of the curve in diagram (a) of the drawing shows the angle or the travel course of the throttle flap position over time. The value entered in the diagram (b) of the drawing concerns the negative change speed of the throttle flap. This value can be determined from the travel course of diagram (a) by means of differentiation simply by changing the throttle flap position in the negative direction.

In this connection, a threshold value is introduced which is given in the diagram (b), and when there is a drop below this threshold value, the formation of the so-called $\Delta\alpha'$-value begins.

First the time point $t_1$ must be determined, which is calculated from exceeding the threshold value given in the following formula.

$$\left(-\frac{d\alpha}{dt}\right) \geqq \left(-\frac{d\alpha}{dt}\right)_{SchAd}$$

From this point $t_1$ on, the course of the curve in diagram (c) will be determined according to the following formula $$\Delta\alpha' = \alpha(t) - \alpha(t_1)$$

At each successive time point and wherein the time raster for the processing may lie at $\Delta t = 10$ ms, the $\Delta\alpha'$-value is determined and only when this value (during travel through a sufficiently large $\Delta\alpha$) exceeds a predetermined threshold value corresponding to the following formula $$|-\Delta\alpha'| \geqq |-\Delta\alpha_{SchAd}|$$

is the inhibit time $t_{VerAd}$ for the mixture adaptation initiated for a predetermined duration at time point $t_1'$.

Should the $d\alpha/dt$-threshold again be exceeded at a later time point $t_2$, which can be obtained from the course of the negative change speed in diagram (b), then the formation of the $\Delta\alpha$-value will again be cancelled so that the sharp drop of the curve shown at time point $t_2$ in the diagram (c) results.

The inhibit time $t_{VerAd}$ for the mixture adaptation can be ended again at this time point $t_2$; it is, however, also possible that the mixture adaptation remains inhibited for a further, subsequent time duration. This time duration can be ended at a desired time point $t_3$ in diagram (c) by running of time or in dependence upon rotational speed.

This entire control sequence of the mixture adaptation inhibit can be completely set forth as software when a microprocessor is utilized; components which are necessary are the throttle flap position indicator as well as a difference formation means for producing the curve course of the diagram (b) and the corresponding comparators. These comparators take as a basis the above-mentioned threshold values and first initiate the formation of the $\Delta\alpha'$-value. From the course of this formed value and its comparison carried out in a further comparator with the threshold value $\Delta\alpha'_{SchAd'}$ these comparators establish the beginning of the inhibit time, for example, as a control signal for a relay-actuated switch. The switch interrupts the transmission of the changing, averaged control quantity from the lambda-regulator to the precontrol region for the inhibit time duration.

It is understood that the foregoing description is that of the preferred embodiments of the invention and that various changes and modifications may be made thereto without departing from the spirit and scope of the invention as defined in the appended claims.

What is claimed is:

1. A method for adapting the mixture control for an internal combustion engine wherein a characteristic field, which is set up from operating quantities of the engine such as throttle flap angular position $\alpha$ and rotational speed n, provides a precontrol quantity governing the quantity of fuel to be metered or injected, the method comprising the steps of:

influencing said precontrol quantity by at least one adaptively changeable corrective quantity (structural adaptation, global adaptation);

detecting the negative change velocity ($-d\alpha/dt$) of the throttle flap position angle ($\alpha$);

comparing said negative change velocity ($-d\alpha/dt$) with a predetermined threshold value;

evaluating a quantity ($\Delta\alpha$) indicative of the throttle flap change in angular position when said threshold value is exceeded, said quantity ($\Delta\alpha$) being so evaluated that the mixture adaptation in the precontrol region is inhibited for a predetermined period of time when said quantity ($\Delta\alpha$) exceeds a corresponding threshold value.

2. The method of claim 1, wherein an $\alpha'$-value is formed which initiates the inhibit time period when said threshold value is exceeded, and wherein said $\alpha'$-value is formed by means of a continuous difference formation in accordance with the equation $$\Delta\alpha' = \alpha(i) - \alpha(t_1)$$

starting at time ($t_1$) at which the negative change velocity ($-d\alpha/dt$) exceeds the threshold value corresponding thereto.

3. The method of claim 1, wherein the inhibition of the mixture adaptation in the precontrol region is ended from the mean value of the $\lambda$-regulating control quantity when a drop occurs below the threshold value corresponding to the negative change velocity ($-d\alpha/dt$).

4. The method of claim 1, wherein the inhibition of the adaptation is ended at a predetermined time after the threshold value of the negative change velocity (rpm-dependent) is exceeded.

5. An arrangement for adapting the mixture control in an internal combustion engine, the arrangement comprising:

characteristic field means set up of operating quantities of the engine such as throttle flap angle $\alpha$ and rotational speed (n);

said characteristic field means including means for providing a precontrol quantity for governing the quantity of fuel to be metered or injected;

means for influencing said precontrol value via at least one adaptively changeable corrective quantity (structural adaptation, global adaptation);

a throttle flap position sensor for providing an output signal indicative of the angular position of the throttle flap;

differentiating means receiving said output signal for determining the negative change velocity of the throttle flap angle ($-d\alpha/dt$);

threshold comparing comparator means receiving said ($-d\alpha/dt$) for providing an indication when the threshold value is exceeded;

means for detecting the extent of the change in the angular position of the throttle flap at the point in time when the threshold value is exceeded by the negative change velocity ($-d\alpha/dt$) and for preventing the mixture adaptation when a predetermined threshold value is exceeded via an interruption or switch over of the connection of the $\lambda$-control output with the precontrol region.

* * * * *

UNITED STATES PATENT AND TRADEMARK OFFICE

CERTIFICATE OF CORRECTION

PATENT NO. : 4,768,490

DATED : September 6, 1988

INVENTOR(S) : Klaus Heck, Günter Plapp and Botho Zichner

It is certified that error appears in the above-identified patent and that said Letters Patent is hereby corrected as shown below:

Under "References Cited", on the title page, delete "4,599,695 6/1986 Deutsch et al" and substitute -- 4,599,695 7/1986 Deutsch -- therefor.

In column 5, line 53: delete "$\Delta\alpha'_{SchAd}$" and substitute -- $-\Delta\alpha'_{SchAd}$ -- therefor.

In column 6, line 11: delete "value;" and substitute -- value [$-d\alpha/dt(SchAd)$]; -- therefor.

In column 6, line 14: insert -- [$-d\alpha/dt(SchAd)$] -- between "value" and "is".

Signed and Sealed this

Tenth Day of April, 1990

*Attest:*

HARRY F. MANBECK, JR.

*Attesting Officer*

*Commissioner of Patents and Trademarks*